United States Patent [19]

Kawamura

[11] Patent Number: 5,063,881

[45] Date of Patent: Nov. 12, 1991

[54] CERAMIC ENGINE

[75] Inventor: Hideo Kawamura, Samukawa, Japan

[73] Assignee: Isuzu Motors Limited, Tokyo, Japan

[21] Appl. No.: 542,506

[22] Filed: Jun. 25, 1990

[30] Foreign Application Priority Data

Jul. 17, 1989 [JP] Japan ..... 1-182454

[51] Int. Cl.[5] ..... F02B 75/12

[52] U.S. Cl. ..... 123/1 A; 123/65 VC; 123/668; 384/907.1

[58] Field of Search ..... 123/197 AC, 65 VC, 56 BC, 123/1 A, 668; 384/907.1

[56] References Cited

U.S. PATENT DOCUMENTS

| | | | |
|---|---|---|---|
| 2,374,959 | 5/1945 | Ruppe | 123/56 BC |
| 4,419,971 | 12/1983 | Nakamura et al. | 123/668 |
| 4,494,286 | 1/1985 | Kaufman | 123/197 AC |
| 4,711,223 | 12/1987 | Carroll | 123/1 A |
| 4,770,549 | 9/1988 | Rokkaku et al. | 384/907.1 |
| 4,779,581 | 10/1988 | Maier | 123/73 A |
| 4,807,577 | 2/1989 | Koutsoupidis | 123/197 AC |
| 4,846,051 | 7/1989 | Wade et al. | 123/193 CP |

FOREIGN PATENT DOCUMENTS

| | | | |
|---|---|---|---|
| 0086521 | 5/1982 | Japan | 123/65 VC |
| 122765 | 7/1984 | Japan . | |
| 87/07325 | 12/1987 | PCT Int'l Appl. | 123/65 VC |

*Primary Examiner*—David A. Okonsky
*Attorney, Agent, or Firm*—Browdy and Neimark

[57] ABSTRACT

In this ceramic engine, the cylinder liners are formed out of a ceramic material, and bearings consisting of a ceramic material are installed in the rotary sliding portions of a crankshaft and larger- and smaller-diameter parts of connecting rods, suction ports being formed in the cylinder liner lower portions so as to be spaced in the circumferential direction thereof, these suction ports and crank chambers communicating via first suction passages, fuel alcohol supply means being provided in second suction passages through which suction air is introduced into the crank chambers. Accordingly, lubricating films of ungasified components of the fuel alcohol are formed on the sliding surfaces of the pistons and cylinder liners and those of the above-mentioned rotary sliding portions, and these sliding surfaces and rotary sliding portions are kept in an excellently lubricated condition owing to such lubricating films. Moreover, the alcohol collected in the crank chambers and the alcohol constituting the lubricating films on the above mentioned sliding surfaces and rotary sliding portions are burnt in order, and suction air is supplied through a low-temperature portion of the engine. Therefore, the suction efficiency does not decrease, and the effciency of the engine can be improved.

6 Claims, 1 Drawing Sheet

CERAMIC ENGINE

BACKGROUND OF THE INVENTION

1. Field of the Invention

This invention relates to a ceramic engine using fuel alcohol.

2. Description of the Prior Art

A conventional heat insulating engine in which a ceramic liner head having cylinder liner upper portions is fitted in a cylinder head is disclosed in, for example, Japanese Patent Laid-open No. 122765/1984.

The conventional 2-cycle engines include a uni-flow scavenging type engine adapted to carry out an asymmetric scavenging operation and capable of carrying out a post-suction operation, in which engine exhaust valves are provided in the exhaust ports formed in a cylinder head, or exhaust ports are provided in the whole circumferences of cylinder liner upper portions, with scavenging ports provided in the whole circumferences of cylinder liner lower portions, whereby the prevention of a mixed flow of the scavenging air and exhaust gas and the improvement of the scavenging efficiency and suction efficiency are effected.

Constructing a 2-cycle heat insulating engine so that the crank chambers function as compressors is generally carried out.

The environmental pollution due to the exhaust gas from an engine has given rise to public discussion, and an alcohol engine has recently attracted public attention. With an alcohol engine, the carbon dioxide and carbide contents of the exhaust gas are very low as compared with those from the engines using gasoline and light oil as fuels.

However, in a 2-cycle engine using alcohol as a fuel, the ignitability of the fuel is inferior. Namely, alcohol requires larger amount of latent heat for the gasification thereof as compared with gasoline and light oil. For example, gasoline requires a latent heat of 0.7% of its heating value, while alcohol requires a latent heat of 5% of its heating value. Namely, alcohol has a property of being difficult to be gasified. Moreover, alcohol injected from the alcohol injectors, i.e. fuel injection nozzles into the air in the suction passages lowers the temperature of suction air, and, when the alcohol mixed with the suction air in this condition are introduced into combustion chambers, the ignition condition of the gaseous mixture is necessarily deteriorated.

Therefore, if a heat insulating engine using alcohol as a fuel is constructed so that the temperature of an engine body as a whole increases to a high level to enable the heat to be taken out from the high-temperature wall surface thereof and the gasification latent heat to be supplied to the sucked alcohol for the gasification thereof, the gasification of the alcohol is promoted, and an excellent gaseous mixture is produced.

However, when the temperature of the engine as a whole is increased to a high level, oil cannot to stored in the crank cases. In such a 2-cycle heat insulating engine, various measures are usually taken for a lubricating system, by which a rotary sliding portion of a crank journal of a crankshaft and those of the larger- and smaller-diameter portions of connecting rods are lubricated, for eliminating this inconvenience. When the sliding portions are heated to a high temperature during the sliding movements of the piston rings and cylinder liners, seizure occurs. Therefore, this type of engine has a problem of how to construct a lubricating system for these sliding portions.

In an engine of a 2-cycle operation, the air suction-/exhaust is carried out as follows. When the exhaust valves are opened to discharge the exhaust gas via the exhaust ports, pressure waves, i.e. pulse waves occur in the cylinders, so that the exhaust gas is thereby forced out. Consequently, fresh air enters the cylinder lower portions and flows into vacuum zones occurring on the rear side of the exhaust gas. Since the cylinder lower portions are heated to not so high a temperature as compared with the cylinder head, the fresh air is not much influenced by the temperature of the inner surfaces thereof. This enables, especially, a heat insulating engine to be operated advantageously, i.e., when a 2-cycle operation is carried out therein to suck fresh air via the cylinder lower portions, the flow rate of the scavenging air or suction air does not decrease.

SUMMARY OF THE INVENTION

An object of the present invention is to solve the above-mentioned problems, and provide a ceramic engine which is constructed by utilizing the property of alcohol that it has a lubricating effect on a ceramic material despite its property that it is difficult to be gasified due to a large amount of its gasification latent heat, and which is adapted to promote the gasification of fuel alcohol with an engine body as a whole including cylinder liners and piston heads maintained at a high temperature; prevent the sliding or rotary sliding portions of cylinder liners, piston rings, connecting rods and a crankshaft from being corroded with alcohol by forming the same sliding and rotary sliding portions out of a ceramic material instead of a metallic material which causes these portions to be corroded with alcohol; and carry out an alcohol-lubricating operation by introducing alcohol first into crank chambers by fuel supply means, such as alcohol injectors provided in the suction passage through which suction air is sent into the crank chambers, whereby the sliding orrotary sliding portions of the crankshaft and connecting rods are lubricated with the alcohol, and then into the combustion chambers therefrom, whereby the sliding portions of the piston rings and cylinder liners are lubricated with the alcohol.

Another object of the present invention is to provide a ceramic engine consisting of rolling bearings of a ceramic material installed in the rotary sliding portions of a ceramic material of cylinder liners, a crankshaft and the larger- and smaller-diameter parts of connecting rods, suction ports formed in cylinder liner lower portions so as to be spaced in the circumferential direction thereof, first suction passages allowing these suction ports and crank chambers to communicate with each other, fuel supply means, such as alcohol injectors provided in second suction passages through which suction air is introduced into the crank chambers, and alcohol ignition means provided in the combustion chambers; and adapted to supply alcohol from the suction ports, which are arranged in the circumferential direction in the parts of the cylinder liner lower portions which are in the vicinity of the bottom dead centers of pistons, into the cylinders while mixing it with the suction air, and form lubricating films, which consist of liquid films composed of the ungasified or atomized components of the alcohol deposited on the surfaces of the liners, and also on the surfaces of piston skirts after the alcohol mixed with the suction air is sucked into the crank chambers, these lubricating films lubricating the sliding portions between the cylinder liners and piston rings or piston skirts during the ascending stroke of the pistons, the lubricating films staying on the inner surfaces of the cylinder liners and lubricating these sliding portions during the descending stroke of the pistons.

The slide-contacting portions of the parts of a ceramic material are subjected to boundary lubrication. When the frictional resistance becomes high, the particles constituting the ceramic material come off, and the slide-contacting portions are lubricated with the ceramic particles falling. In order to reduce the friction between parts of a ceramic material in sliding motion, it is preferable to retain a fluid in the pores in the surfaces of the parts of a ceramic material. The liquid films mentioned above function as a fluid to be retained in the pores in the ceramic surfaces, and these liquid films work as lubricating films and help the parts of a ceramic material to be slid smoothly with respect to the sliding movements of the cylinder liners and piston rings or piston skirts during an ascending stroke of the pistons. Furthermore, these lubricating films stay on the inner surfaces of the cylinder liners and help these sliding portions to be slid smoothly during a descending stroke of the pistons.

When the fuel alcohol is sucked from the suction passages into crank chambers as it is mixed with the suction air, the fuel is maintained in the form of mist or turns into mist due to the rotational movement of the crankshaft, and the ungasified or atomized components of the alcohol are deposited on the surfaces of the piston skirts to form lubricating films of alcohol, with which the sliding portions mentioned above are lubricated in accordance with the reciprocating movements of the pistons.

Still another object of the present invention is to provide a ceramic engine having ceramic roller bearings installed in the rotary sliding portions of a journal of a crankshaft and the larger-diameter parts of connecting rods, and ball bearings installed in the rotary sliding portions of the journal and the smaller-diameter parts of the connecting rods, whereby the alcohol sucked into crank chambers helps the rotary sliding portions of the crankshaft and the larger- and smaller-diameter parts of the connecting rods to be lubricated without corroding the same, this enabling the sliding characteristics of these portions to be improved, the reciprocating movements of the pistons to be smoothly converted into rotational movement of the crank, and the engine output to be heightened.

A further object of the present invention is to provide a ceramic engine in which a heat insulating material is arranged on the lower surface of a cylinder head and the outer circumferences of the cylinder liner upper portions since the alcohol requires high gasification latent heat as compared with gasoline and light oil and is difficult to be gasified, by which heat insulating structure an engine body as a whole is maintained at a high temperature to promote the gasification of the alcohol, the alcohol collected in the crank chambers being kept misty or producing mist in accordance with the movements of the crankshaft and connecting rods to be gasified sequentially, sent into the combustion chambers and burnt, a gaseous mixture of the suction air and alcohol being introduced into the crank chambers to increase the pressure therein to a high level and prevent the blowby of the gas.

A further object of the present invention is to provide a ceramic engine in which a heat insulating material is arranged on the lower surface of a cylinder head and the outer circumferences of the cylinder liner upper portions, suction ports being formed in the cylinder liner lower portions so as to introduce the suction air from a low-temperature zone into the cylinders, so that the cylinder head constitutes a high-temperature zone, this enabling the suction air, i.e. fresh air to become free from the influence of the heat from the high-temperature zone since the cylinder lower portions constitute a low-temperature zone, whereby the thermal expansion of air which cause a decrease in the flow rate of the suction air does not occur even though this engine is a heat insulating engine.

A further object of the present invention is to provide a ceramic engine of a uni-flow type structure with exhaust valves provided in a cylinder head, adapted to carry out a scavenging operation by air currents flowing in a predetermined direction with respect to the center line of the cylinder and discharge an exhaust gas efficiently via exhaust ports, and thereafter introduce suction air into the space on the rear side of the pulse waves of the exhaust gas so that a vacuum zone is filled with the suction air, whereby the air current flows in a single direction to enable a decrease in the suction efficiency to be minimized since the suction air is introduced from the cylinder liner lower portions into combustion chambers even when the temperature of the walls of the cylinder head and cylinder upper portions is high, and the efficiency of the engine to be improved.

An additional object of the present invention is to provide a ceramic engine in which check valves are provided in the portions at which crank chambers and second suction passages into which suction air is introduce from the outside communicate with each other, whereby the reverse flow of a fluid from the crank chambers to the second suction passages is prevented.

DESCRIPTION OF THE PREFERRED EMBODIMENT

Figure 1:
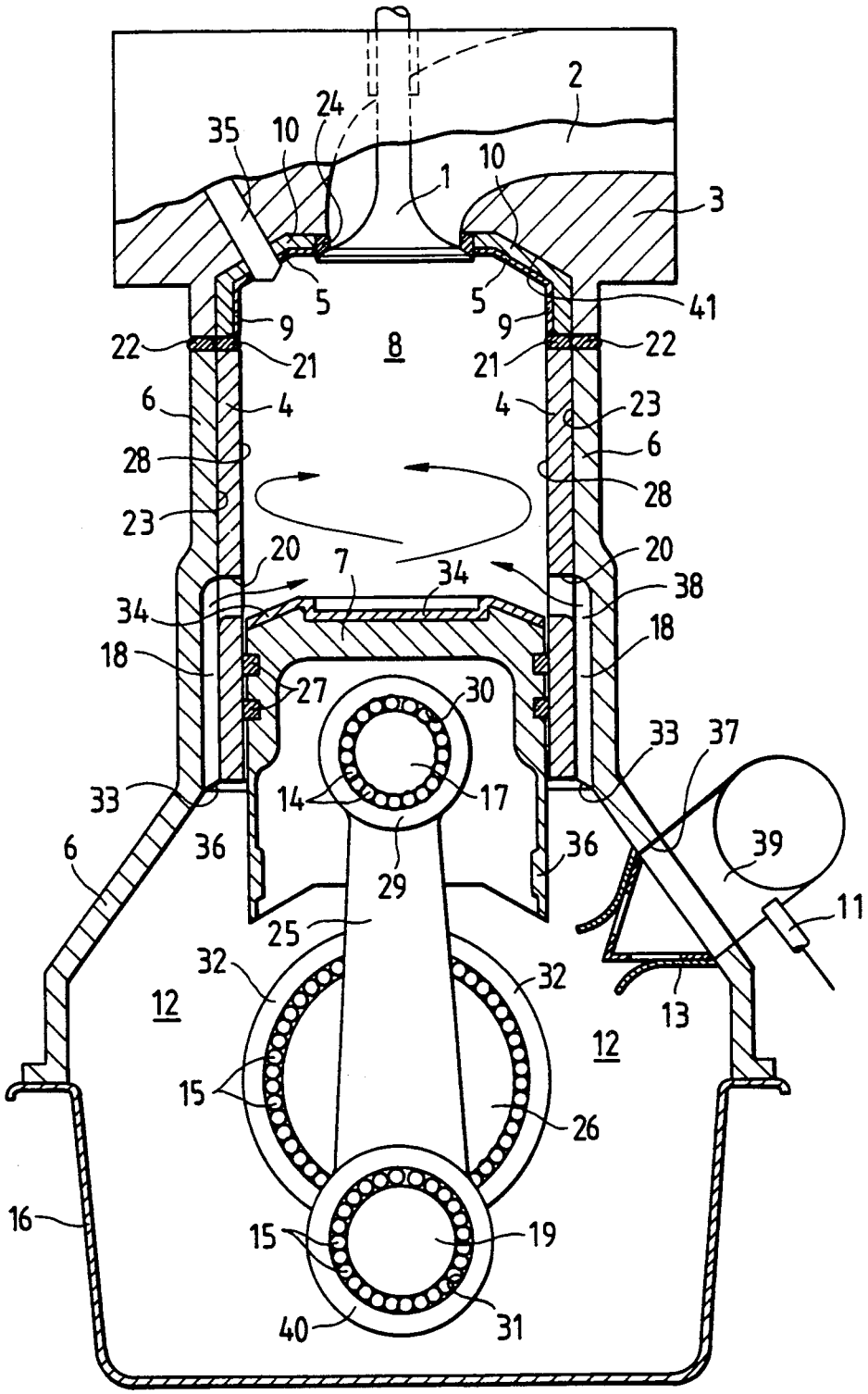
FIG. 1 is a schematic section illustrating an embodiment of the ceramic engine using alcohol as a fuel according to the present invention.

An embodiment of the ceramic engine using alcohol as a fuel according to the present invention will now be described with the drawing.

FIG. 1 shows an embodiment of the ceramic engine according to the present invention. This ceramic engine is a uni-flow scavenging type engine, which is provided with exhaust valves 1 in a cylinder head 3, and suction ports 20 in the lower portions of cylinder liners 4 so as to be spaced in the circumferential direction thereof, and which works as a 2-cycle engine utilizing crank chambers 12 as compressors, whereby a scavenging operation is carried out by air currents flowing in a predetermined direction with respect to the center lines of cylinders to enable the efficiency of the engine to be improved.

In this ceramic engine, the cylinder head 3 is fixed to a cylinder block 6 via gaskets 22, and head liners consisting of integrally formed cylinder head lower surface portions 5 and cylinder liner upper portions 9 are fitted firmly in a bore 41 formed in the cylinder head 3, via heat insulating gaskets 10. These head liners constitute the combustion chambers 8 and are formed out of a ceramic material, such as zirconia ($ZrO_2$), silicon nitride ($Si_3N_4$), silicon carbide (SiC) and aluminum titanate, the head liners being characterized, especially, by their heat resistance. The heat insulating gaskets 10 are formed out of a heat insulating material, such as aluminum titanate and potassium titanate and disposed between the bore 41 in the cylinder head 3 and the outer surfaces of the head liners. Owing to the installation of these heat insualting gaskets 10, the upper portions of the combustion chambers 8 form heat insulating structures, so that the diffusion of heat from the upper portions of the combustion chambers to the cylinder head 3 is prevented. The exhaust ports 2 formed in the cylinder head lower surface portions 5, which consist of heat insulating structures, are provided with valve seats 24, on which exhaust valves 1 are provided. The cylinder head 3 is further provided with ignition plugs 35 as means for igniting a gaseous mixture of air and alcohol.

The cylinder liners 4 forming the cylinders are fitted in bores 23 formed in the cylinder block 6. Heat insulating gaskets 21 consisting of a heat insulating material are interposed between the cylinder liner upper portions 9 and cylinder liners 4 so as to prevent the heat of the cylinder liner upper portions 9 from being transmitted to the cylinder liners 4. The combustion chambers 8 are formed by being surrounded by the cylinder head liners consisting of the cylinder head lower surface portions 5 and liner upper portions 9, cylinder liners 4 and the heads of the pistons 7. The cylinder liners 4, which provide sliding surfaces 28 along which the pistons 7 are moved reciprocatingly, are formed out of a ceramic material, which does not react with fuel alcohol, such as circonia ($ZrO_2$) or silicon carbide (SiC). This ceramic engine uses alcohol as a fuel. Accordingly, when the cylinder liners 4 providing the sliding surfaces 28 are formed out of a ceramic material of silicon nitride ($Si_3N_4$), the silicon nitride is melted in the water, which is contained in the alcohol, during the sliding movement thereof, i.e., with a load imparted thereto. The silicon nitride then reacts with the water to produce silicide, so that the cylinder liners 4 would be worn out. Therefore, such cylinder liners are not preferable. Consequently, it is preferable that the cylinder liners 4 be formed out of the above-mentioned ceramic materials which are not melted during the sliding movements thereof. On the lower side of the cylinder block 6, a crank chamber 12 is formed, which consists of a portion of the cylinder block 6, and a crank case 16 fixed unitarily to the lower portion of the cylinder block 6.

The pistons 7 adapted to be moved reciprocatingly in the cylinders, i.e. cylinder liners, and not shown in detail in the drawing can be formed with piston head portions 34 and piston skirt portions 36, and the piston head portions 34 can be formed in a heat insulating state out of a heat insulating material, such as zirconia ($ZrO_2$) and aluminum titanate, and a ceramic material. Piston rings 27 are fitted in the grooves in the pistons 7. Since these piston rings 27 are sliding parts just as the cylinder liners 4, the sliding surfaces of the piston rings 27 are formed out of a ceramic material, such as zirconia ($ZrO_2$) and silicon carbide (SiC), which do not react with fuel alcohol, as in the case of the cylinder liners 4. As long as the sliding surfaces of the piston rings 27 are formed out of a ceramic material mentioned above, a sufficient effect can, of course, be obtained even if the piston ring bodies are merely coated with this ceramic material.

In this ceramic engine, the cylinder block 6 is provided at its lower inner circumferential portion with annular circumferentially extending suction ports 38 opposed to the suction ports 20 formed in the cylinder liners 4. First suction passages 18 allowing the crank chambers 12 to communicate with the suction ports 38 are formed so as to introduce suction air into the suction ports 38. The crank chambers 12 are provided with communication ports 37 formed in the crank cases 16, and the communication ports 37 have therein check valves 13 consisting of lead valves and operated for preventing the compressed air in the crank chambers 12 from flowing back to second suction passages 39. The second suction passages 39 are provided with alcohol injectors 11 for use in sucking alcohol with suction air into the crank chambers 12.

The second suction passages 39 communicate with a supercharger (not shown), for example, a turbocharger and a compressor. Owing to this structure, the fuel alcohol injected into the second suction passages 39 is mixed with the suction air, and the resultant gaseous mixture is sucked into the crank chambers 12 through the check valves 13 provided in the communication ports 37. The gaseous mixture sucked into the crank chambers 12 is sucked from the communication ports 33 formed between the end portions of the cylidner liners 4 and the cylinders 23 formed in the cylinder block 6 into the interior of the cylinders, i.e. combustion chambers 8 through the first suction passages 18, suction ports 38 and suction ports 20.

The ceramic engine according to the present invention is characterized by the following structure as well in addition to the above-described structure. In order to reciprocatingly move the pistons 7, the smaller-diameter portions 29 of connecting rods 25 are connected thereto so that the smaller-diameter portions 29 can be rotationally slid. The piston pins 17 are fixed in bores 30 in the bosses of the pistons 7 so that the piston pins 17 can be rotationally slid, and the smaller-diameter portions 29 of the connecting rods 25 are connected to the piston pins 17 so that the smaller-diameter portions 29 can be rotationally slid. Rolling bearings consisting of rolling elements are installed between the piston pins 17 and bores 30 for piston pins, and between the smaller-diameter portions 29 of the connecting rods 25 and the piston pins 17. These rolling bearings consist of ball bearings composed of ceramic balls 14 constituting rolling elements. Accordingly, the bosses having bores 30 for piston pins and the smaller-diameter portions 29 of the connecting rods 25 form parts equivalent to the outer races of ordinary ball bearings, and the piston pins 17 parts equivalent to the inner races thereof.

The larger-diameter portions 40 of the connecting rods 25 are joined crank pins 19 of the crankshaft so that the larger-diameter portions 40 can be rotationally slided. Namely, rolling bearings consisting of rolling elements are installed between the inner surfaces of bores 31 for the crank pins formed in the larger-diameter portions of the connecting rods 25 and the outer surfaces of the crank pins 19. These rolling bearings consist of roller bearings composed of ceramic rollers 15 constituting the rolling elements Accordingly, the larger-diameter portions 40 having the bores 31 for crank pins form parts equivalent to the outer races of ordinary roller bearings, and the crank pins 19 parts equivalent to the inner races thereof.

In order to fix the crankshaft rotatably in bearing portions 32 for the cylinder block 6, rolling bearings consisting of rolling elements are installed between the outer surfaces of crank journals 26 of the crankshaft and the inner surfaces of the bearing portions 32. These rolling bearings consist of roller bearings composed of ceramic rollers 15 constituting the rolling elements. Accordingly, the bearing portions 32 of the cylinder block 6 form parts equivalent to the outer races of ordinary roller bearings, and the crank journals 26 parts equivalent to the inner races thereof.

In the ceramic engine according to the present invention, alcohol is introduced as a fuel into the crank chambers 12 as mentioned above. Therefore, it is preferable that the ball bearings and roller bearings referred to above be formed out of a ceramic material, such as zirconia ($ZrO_2$) and silicon carbide (SiC) just as the above-mentioned parts having sliding surfaces.

What is claimed is:

1. A ceramic engine comprising:

a cylinder block, ceramic cylinder liners fitted in bores in said cylinder block so as to form cylinders, crank chambers formed with a lower portion of said cylinder block at the lower sides of said cylinder liners, a cylinder head fixed to said cylinder block, exhaust ports formed in said cylinder head, exhaust valves provided for opening and closing said exhaust ports, suction ports formed at the lower circumferential portions of said cylinder liners, first suction passages allowing said suction ports and said crank chambers to communicate with each other, pistons adapted to be moved reciprocatingly in said cylinder liners, piston pins set in said pistons, connecting rods joined rotatably at the smaller-diameter portions at one end part of each thereof to said piston pins, a crankshaft joined rotatably to larger diameter portions at the other end part of each of said connecting rods so as to extend in said crank chambers, and supported rotatably at both end portions thereof on said cylinder block, rolling bearings consisting of ceramic rolling elements installed in rotary sliding parts of said crankshaft and said larger-diameter portions of said connecting rods, rotary sliding parts at which said crankshaft is supported rotatably on a lower portion of said cylinder block, rotary sliding parts of said piston pins and said smaller-diameter portions of said connecting rods, second suction passages through which suction air is introduced into said crank chambers, fuel supply means for supplying fuel from said second suction passages into said cylinders through said crank chambers and said first suction passages, ignition means provided in said combustion chambers and adapted to ignite said fuel; and means for burning alcohol as said fuel, and whereby said fuel supply means further comprises means to suck the alcohol therethrough into said crank chambers for lubricating said ceramic rolling bearings of said crank shaft and said connecting rods with the alcohol, and means for then supplying the alcohol from said crank chambers to said cylinders through said first suction passages to lubricate the sliding surfaces of said said ceramic cylinder liners and said pistons, the alcohol then being ignited and burnt by said ignition means.

2. A ceramic engine according to claim 1, wherein said fuel supply means consist of alcohol injectors provided in said second suction passages.

3. A ceramic engine according to claim 1, wherein the portions through which said crank chambers and said second suction passages communicate with each other are formed so as to prevent a fluid from flowing reversely from said crank chambers to said second suction passages.

4. A ceramic engine according to claim 1, wherein said rolling bearings installed in said rotary sliding parts of said crankshaft and said larger-diameter portions of said connecting rods, and said rotary sliding portions at which said crankshaft is supported rotably on the lower portion of said cylinder block consist of roller bearings composed of ceramic rollers.

5. A ceramic engine according to claim 1, wherein said rolling bearings installed in said rotary sliding parts of said piston pins and said smaller-diameter portions of said connecting rods consist of ball bearings composed of ceramic balls.

6. A ceramic engine comprising:

a cylinder block, ceramic cylinder liners fitted in bores in said cylinder block so as to form cylinders, crank chambers formed with a lower portion of said cylinder block at the lower side of said cylinder liners, a cylinder head fixed to said cylinder block, bores formed in said cylinder head, cylinder head liners which consist of ceramic cylinder head lower surface portions provided with exhaust ports, and ceramic cylinder liner upper portions formed integrally with said cylinder head lower surface portions, and which are provided in said bores, heat insulating gaskets provided between said cylinder head liners and said bores in said cylinder head and consisting of a heat insulating material, exhaust valves provided for opening and closing said exhaust ports, suction ports formed at the lower circumferential portions of said cylinder liners, first suction passages allowing said suction ports and said crank chambers to communicate with each other, pistons adapted to be moved reciprocatingly in said cylinder liners, piston pins set in said pistons, connecting rods joined rotatably at the smaller-diameter portions at one end part of each thereof to said piston pins, a crankshaft joined rotatably to larger-diameter portions at the other end part of each of said connecting rods so as to extend in said crank chambers, and supported rotatably at both end portions thereof on said cylinder block, rolling bearings consisting of ceramic rolling elements installed in rotary sliding parts of said crankshaft and said larger-diameter portions of said connecting rods, rotary sliding parts at which said crankshaft is supported rotatably on a lower portion of said cylinder block, rotary sliding parts of said piston pins and said smaller diameter portions of said connecting rods, second suction passages through which suction air is introduced into said crank chambers, fuel supply means for supplying fuel from said second suction passages into said cylinders through said crank chambers and said first suction passages, ignition means provided in said combustion chambers and adapted to ignite said fuel; and means for burning alcohol as said fuel, and whereby said fuel supply means further comprises means to suck the alcohol therethrough into said crank chambers for lubricating said ceramic rolling bearings of said crank shaft and said connecting rods with the alcohol, and means for then supplying the alcohol from said crank chambers to said cylinders through said first suction passages to lubricate the sliding surfaces of said said ceramic cylinder liners and said pistons, the alcohol then being ignited and burnt by said ignition means.

* * * * *